US007913498B2

(12) United States Patent
Rowatt

(10) Patent No.: US 7,913,498 B2
(45) Date of Patent: Mar. 29, 2011

(54) ELECTRICAL SUBMERSIBLE PUMPING SYSTEMS HAVING STIRLING COOLERS

(75) Inventor: John David Rowatt, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1187 days.

(21) Appl. No.: 11/458,117

(22) Filed: Jul. 18, 2006

(65) Prior Publication Data

US 2006/0266064 A1 Nov. 30, 2006

Related U.S. Application Data

(63) Continuation-in-part of application No. 10/710,103, filed on Jun. 18, 2004.

(60) Provisional application No. 60/517,782, filed on Nov. 6, 2003.

(51) Int. Cl.
*F25B 1/00* (2006.01)

(52) U.S. Cl. ..... 62/115; 62/259.2; 62/260

(58) Field of Classification Search ..... 62/259.2, 62/6, 160, 185, 186, 260, 451, 517, 519, 62/520, 115; 257/666–686
See application file for complete search history.

(56) References Cited

U.S. PATENT DOCUMENTS

| | | | | |
|---|---|---|---|---|
| 2,671,323 | A | | 3/1951 | Richert |
| 2,711,084 | A | | 6/1955 | Bergan |
| 3,038,074 | A | | 6/1962 | Scherbatskoy |
| 3,597,766 | A | | 8/1971 | Buck |
| 3,630,282 | A | | 12/1971 | Lanmon, II |
| 4,375,157 | A | | 3/1983 | Boesen |
| 4,407,136 | A | | 10/1983 | de Kanter |
| 4,413,475 | A | | 11/1983 | Moscrip |
| 4,805,407 | A | | 2/1989 | Buchanan |
| 4,897,997 | A | | 2/1990 | Meijer et al. |
| 5,265,677 | A | | 11/1993 | Schultz |
| 5,502,968 | A | | 4/1996 | Beale |
| 5,554,897 | A | | 9/1996 | Martin et al. |
| 5,647,217 | A | | 7/1997 | Penswick et al. |
| 5,701,751 | A | | 12/1997 | Flores |
| 5,715,895 | A | | 2/1998 | Champness et al. |
| 5,720,342 | A | | 2/1998 | Owens et al. |
| 5,749,226 | A | * | 5/1998 | Bowman et al. ..... 60/520 |
| 5,765,377 | A | | 6/1998 | Kim |
| 5,931,000 | A | | 8/1999 | Turner et al. |
| 6,109,040 | A | | 8/2000 | Ellison et al. |
| 6,138,459 | A | * | 10/2000 | Yatsuzuka et al. ..... 62/6 |
| 6,145,597 | A | * | 11/2000 | Kobylinski ..... 166/384 |
| 6,167,965 | B1 | * | 1/2001 | Bearden et al. ..... 166/250.15 |
| 6,220,355 | B1 | | 4/2001 | French |
| 6,266,963 | B1 | | 7/2001 | Rudick |
| 6,272,867 | B1 | | 8/2001 | Barrash et al. |

(Continued)

FOREIGN PATENT DOCUMENTS

JP 2000274855 A 10/2000

*Primary Examiner* — Mohammad M Ali
(74) *Attorney, Agent, or Firm* — Kevin B. McGoff; Rodney V. Warfford; Tim Curington

(57) ABSTRACT

A submersible pumping system includes a submersible pump; a gauge disposed proximate the submersible pump; a Stirling cooler disposed proximate the gauge, wherein the Stirling cooler has a cold end configured to remove heat from the gauge and a hot end configured to dissipate heat; and an energy source configured to power the submersible pumping system.

17 Claims, 7 Drawing Sheets

U.S. PATENT DOCUMENTS 6,336,408 B1 1/2002 Parrott et al.
6,341,498 B1 1/2002 DiFoggio
6,347,524 B1 2/2002 Barrash et al.
6,481,216 B2 11/2002 Simmons et al.
6,532,749 B2 3/2003 Rudick et al.
6,536,218 B1 * 3/2003 Steinmeyer ..... 62/6
6,536,326 B2 * 3/2003 Unger et al. ..... 91/361
6,550,255 B2 4/2003 Rudick et al.
6,672,093 B2 1/2004 DiFoggio
6,675,588 B2 1/2004 Rudick
6,695,052 B2 * 2/2004 Branstetter et al. ..... 166/250.15
6,769,487 B2 8/2004 Hache
6,779,349 B2 8/2004 Yoshimura
6,806,604 B2 * 10/2004 Werfel et al. ..... 310/90.5
6,843,057 B2 1/2005 Yamamoto
6,877,332 B2 4/2005 DiFoggio
2002/0005043 A1 1/2002 Rudick et al.
2002/0020535 A1 2/2002 Johnson et al.
2002/0023456 A1 2/2002 Sone
2002/0134089 A1 9/2002 Rudick
2002/0134090 A1 9/2002 Rudick et al.
2003/0089498 A1 5/2003 Johnson et al.
2004/0055313 A1 3/2004 Navedo et al.
2004/0056541 A1 3/2004 Steinmeyer
2004/0211894 A1 10/2004 Hother et al.
2004/0264543 A1 12/2004 Storm et al.

* cited by examiner

ELECTRICAL SUBMERSIBLE PUMPING SYSTEMS HAVING STIRLING COOLERS

CROSS-REFERENCE TO RELATED APPLICATIONS

This is a Continuation-In-Part of application Ser. No. 10/710,103, filed on Jun. 18, 2004, which claims priority of Provisional Patent Application Ser. No. 60/517,782, filed on Nov. 6, 2003. This application claims benefits of these prior applications, which are incorporated by reference in their entireties.

BACKGROUND OF INVENTION

1. Field of the Invention

This invention relates generally to techniques for maintaining downhole tools and their components within a desired temperature range in high-temp environments, and, more specifically, to an electrical submersible pumping system having a Stirling-Cycle cooling system.

2. Background Art

Electrical submersible pumping systems (ESPs) are used for artificial lifting of fluid from a well or reservoir. An ESP typically comprises an electrical submersible motor, a seal section (sometimes referred to in the art as a protector), and a pump having one or more pump stages inside a housing. The seal section (or protector) functions to equalize the pressure between the inside of the system and the outside and also acts as a reservoir for compensating the internal oil expansion from the motor. The protector may be formed of metal, as in a bellows device, or an elastomer. An elastomer protector is sometimes referred to as a protector bag.

In addition to motors, pump sections, and seals, a typical submersible pumping system may further comprise a variety of additional components, such as a connector used to connect the submersible pumping system to a deployment system. Conventional deployment systems include production tubing, cable and coiled tubing. Additionally, power is supplied to the submersible electric motor via a power cable that runs through or along the deployment system.

ESPs often incorporate the use of a gauge having one or more sensors and associated electronics for measuring and monitoring parameters related to the operation of the ESP and the production of fluid from the well or reservoir. These parameters may include, but are not limited to, motor temperature, well temperature, pump intake pressure, pump discharge pressure, and vibration. The gauge is typically located below the motor, from which it may draw electrical power. The sensors and associated electronics included in the gauge are housed in protective chamber to isolate them from well fluids and well conditions, such as high temperature (up to 350° F.) or pressure (up to 30,000 psi) which may compromise their operation. The power cable used to provide power to the motor may also be used as a means for transmitting data from the gauge to the surface, where the data are interpreted and the operational parameters of the ESP can be adjusted to optimize the production of fluid from the well or reservoir.

Currently, ESPs are rated for use up to 550° F., but the electronics controlling or monitoring the pump fails at these high temperatures and is generally not reliable above 300° F. These electronic components generally cannot function at high temperature without significant degradation of their lifetime or performance. These components are typically contained in a closed protective (insulating) chamber. The accumulation or transfer of heat into the chamber can raise the temperature inside the chamber to a point that exceeds the maximum operating temperature of the components. The heat source which raises the temperature inside the chamber may be the components themselves (e.g., electrical losses) or high temperature well fluids external to the tool.

In addition, in certain high temperature thermal recovery production methods, such as Steam Assisted Gravity Drainage (SAGD), ESPs will be subject to well temperatures exceeding the maximum operating temperature of the gauge (about 300° F.). These high temperatures may also destroy or weaken the seals, insulating materials, and other components of the submersible pumping system. Under these conditions, the use of a gauge for monitoring and optimizing production is compromised. This can have a substantial negative impact on the overall performance of a well and thus the economics of producing fluids from the well. As such, it is desirable to provide a means for cooling the gauge (or other components of a submersible pumping system) such that the operational temperature of the gauge and components is maintained within an acceptable temperature range conducive to reliable operation of the gauge in harsh operating environments.

SUMMARY OF INVENTION

One aspect of the invention relates to submersible pumping systems. A submersible pumping system in accordance with one embodiment of the invention includes a submersible pump; a gauge disposed proximate the submersible pump; a Stirling cooler disposed proximate the gauge, wherein the Stirling cooler has a cold end configured to remove heat from the gauge and a hot end configured to dissipate heat; and an energy source configured to power the submersible pumping system.

One aspect of the invention relates to methods for constructing a submersible pumping system. A method in accordance with one embodiment of the invention includes disposing a gauge proximate a submersible pump; and disposing a Stirling cooler proximate the gauge such that the Stirling cooler is configured to remove heat from the gauge.

One aspect of the invention relates to methods for methods for cooling a gauge of a submersible pumping system. A method in accordance with one embodiment of the invention includes providing a Stirling cooler proximate the gauge; and energizing the Stirling cooler such that heat is removed from the gauge.

Other aspects and advantages of the invention will be apparent from the following description and the appended claims.

DETAILED DESCRIPTION

Embodiments of the invention relate to the use, construction and method of using a Stirling-cycle based cooling system to cool components (e.g., electrical components and sensors in a gauge) connected to an electrical submersible pumping (ESP) system. As noted above, ESPs are typically subject to extreme high temperatures that can degrade the performance of their electronic components or sensors. A thermal management solution using a Stirling cooler as a heat pump could keep the temperature of the electronics below the temperature of the well and within its rated operating temperature range, thus drastically improving the reliability of ESP's electronic module. Part of the fluid pumped by the ESP could be forced to circulate around the hot end of the Stirling cooler to keep the Stirling cooler reject temperature close to the well temperature The Stirling-cycle cooling system functions efficiently in a closed system, requires no lubrication, and can function at relatively lower pressures as compared to prior art vapor compression cooling system. A Stirling cycle cooler is based on the well known Stirling thermodynamic cycle. A Stirling cooler uses mechanical energy to produce a temperature difference between the cold end and the hot end of the cooler. This temperature difference can be used to remove heat from an object to be cooled.

Various configurations of Stirling engines/coolers have been devised. These can be categorized into kinematic and free-piston types. Kinematic Stirling engines use pistons attached to drive mechanisms to convert linear motions of the pistons to rotary motions. Kinematic Stirling engines can be further classified as alpha type (two pistons), beta type (piston and displacer in one cylinder), and gamma type (piston and displacer in separate cylinders). Free-piston Stirling engines use harmonic motion mechanics, which may use planar springs or magnetic field oscillations to provide the harmonic motion.

Due to daunting engineering challenges, Stirling cycle engines are rarely used in practical applications and Stirling cycle coolers have been limited to the specialty field of cryogenics and military use. The development of Stirling engines/coolers involves such practical considerations as efficiency, vibration, lifetime, and cost. Using Stirling engines/coolers on downhole tools presents additional difficulties because of the limited space available in a downhole tool (typically 3-6 inches in diameter) and the harsh downhole environments (e.g., temperatures up to 260° C. and pressures up to 30,000 psi or more). Stirling engines have been proposed for use as electricity generators for downhole tools (See U.S. Pat. No. 4,805,407 issued to Buchanan).

Embodiments of the present invention may use any Stirling cooler designs. Some embodiments use free-piston Stirling coolers. One free-piston Stirling cooler embodiment of the invention makes use of a moving magnet linear motor.

Figure 1:
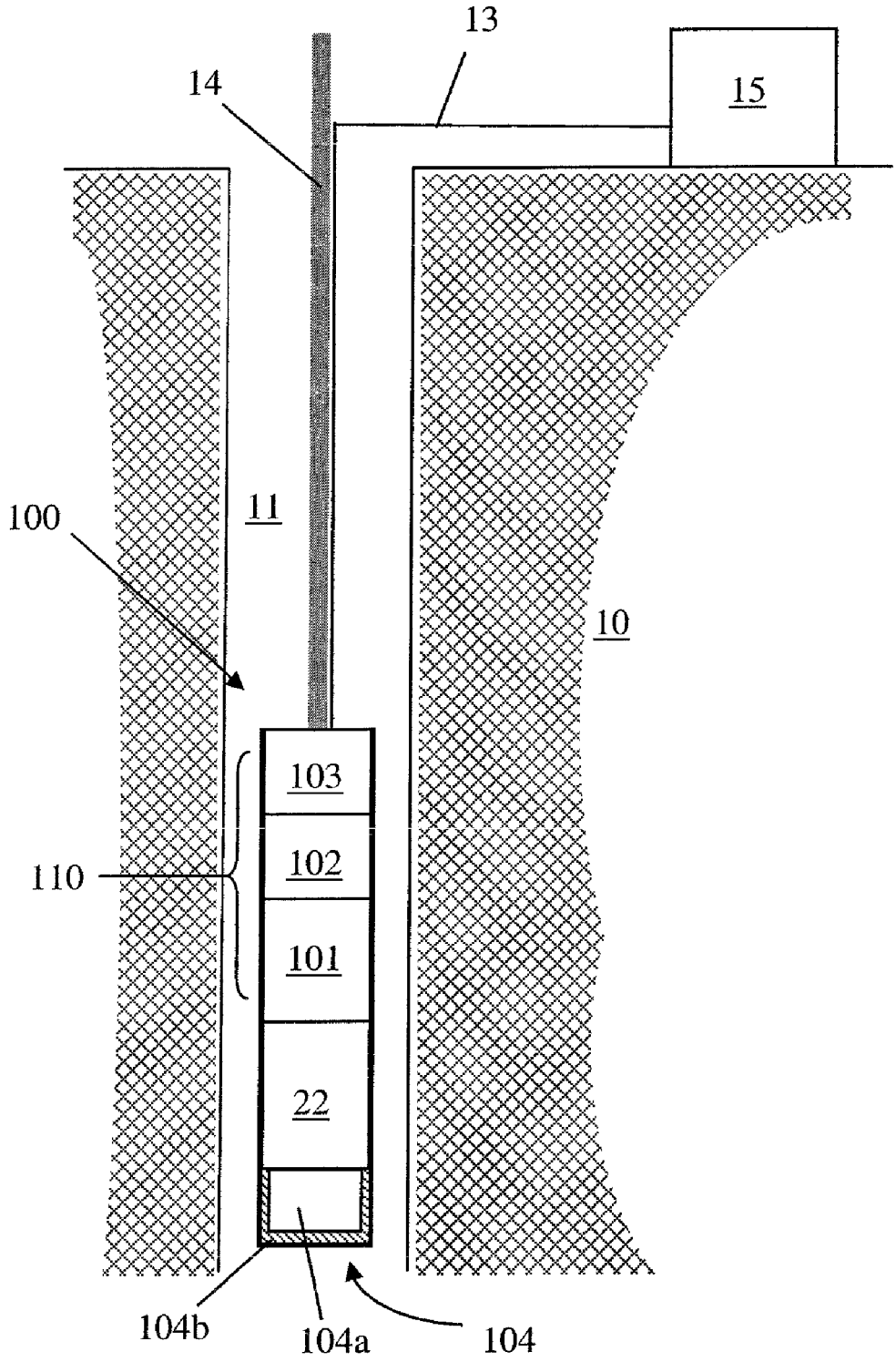
FIG. 1 shows a submersible pumping system in accordance with one embodiment of the invention disposed in a borehole.

FIG. 1, shows a schematic of a submersible pumping system in accordance with one embodiment of the invention. As shown in FIG. 1, a submersible pumping system 100 is disposed in a wellbore 11, which penetrates the formation 10, for pumping formation fluids to the surface via the production tubing 14. The submersible pumping system 100 comprises a pump section 110, a Stirling cooler 104, and a gauge 104. The pump section 110 comprises a motor 101, seal section (protector) 102, and one or more pumps 103. Note that the order of the components shown here is for illustration only. One of ordinary skill in the art would appreciate that other arrangements are also possible without departing from the scope of the invention.

Power may be supplied to the motor via a power cable 13 from a power source 15 on the surface. Alternatively, power may be supplied by a battery or other power source downhole. A gauge 104, which contains one or more sensors **104*a*, is shown below the base of the motor 101. Note that the gauge 104 may also be disposed at other locations, e.g., above the pump 103. The gauge 104 consists of a housing that protects the various sensors and components 104*a* contained in the gauge 104. These components 104*a* may include electronics that need to be protected from high temperatures. The components are disposed in an insulating enclosure or chamber 104*b* and connected to a Stirling cooler 22. The Stirling cooler 22 is shown connected to the motor 101. However, the Stirling cooler 22 may also be arranged at other locations, and other power sources may be used. In the particular arrangement shown in this figure, the Stirling cooler 22 is conveniently arranged below the motor 101 such that the submersible pumping system motor 101 can be used to power both the Stirling cooler 22 and the gauge 104. Further, a means to remove heat from the hot end of the Stirling cooler can be incorporated in this arrangement to take advantage of the flow of well fluid passing by the motor 101** for removal of heat by convective heat transfer.

Figure 2:
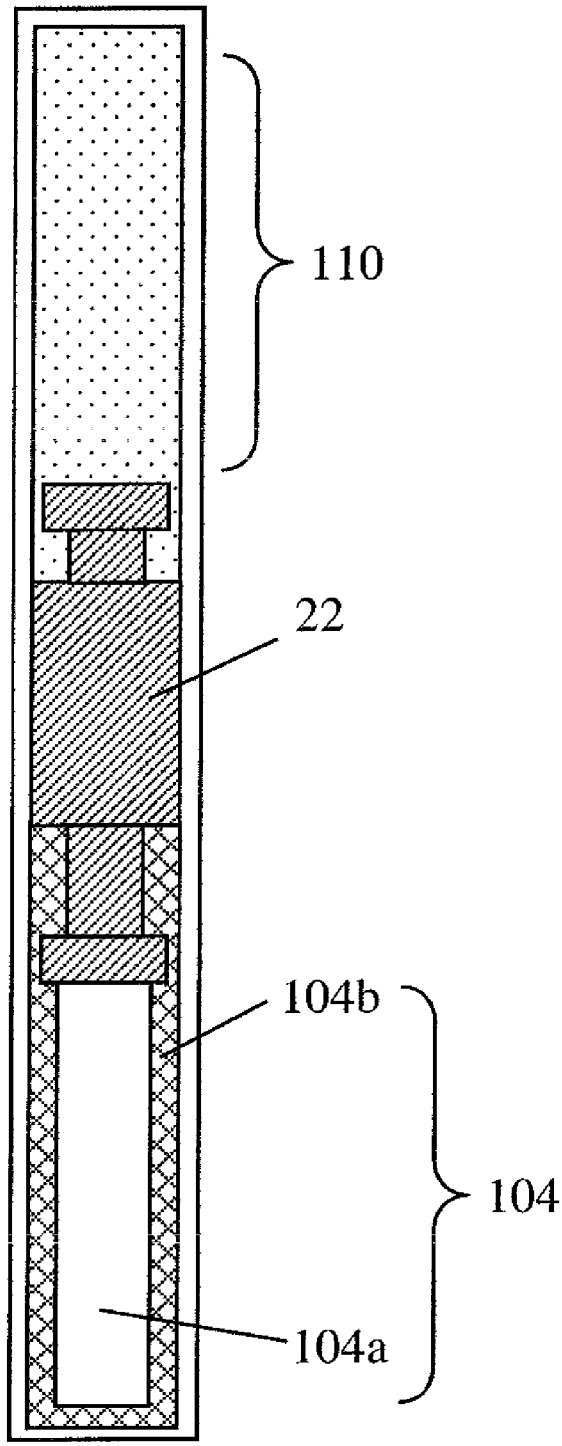
FIG. 2 shows an expanded section of the submersible pumping system of FIG. 1.

FIG. 2 shows an expanded section of the pumping system shown in FIG. 1 for better illustration. FIG. 2 shows the arrangement of gauge 104, the Stirling cooler 22, and the pump section 110. As shown, the Stirling cooler 22, which is in direct contact with the gauge 104 acts as a heat pump to remove heat from the gauge 104. The heat may be dissipated to the well fluid flowing past the motor. In this manner, the heat removed from the gauge is effectively "pumped" to the other end of the Stirling cooler and dissipated into the flow of well fluid passing the submersible motor.

Figure 3:
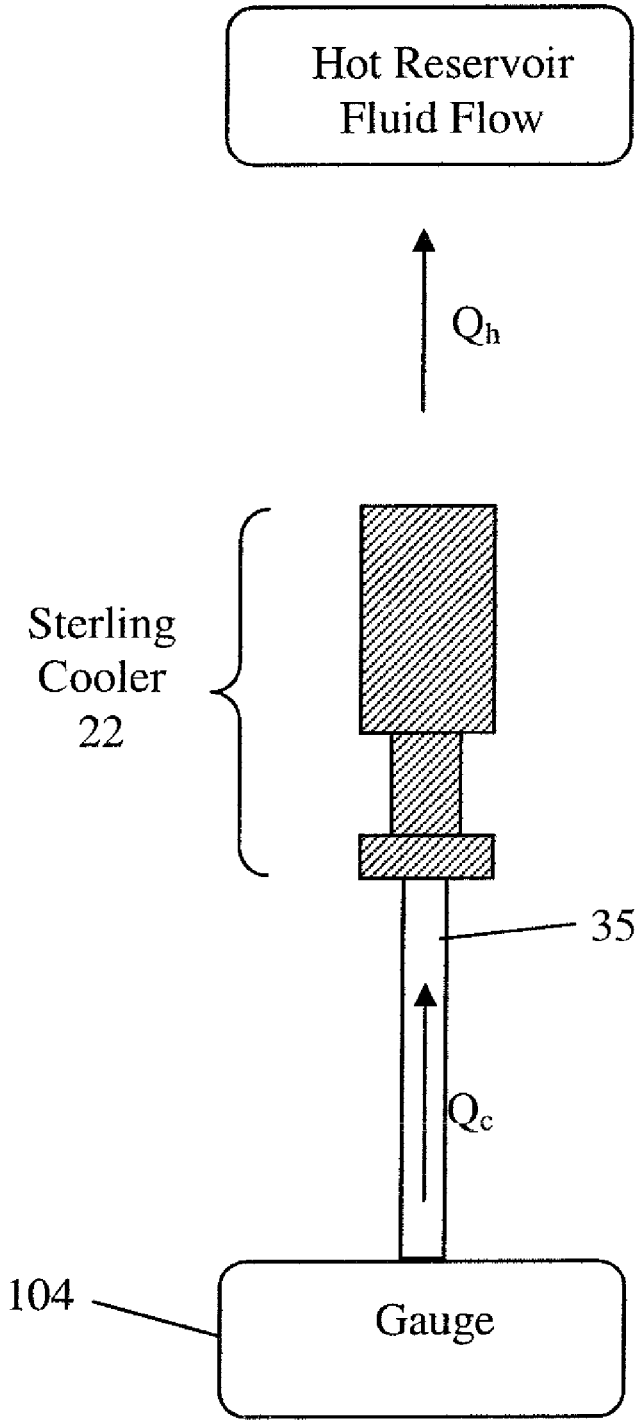
FIG. 3 shows a schematic illustrating heat transfer using a Stirling cooler in accordance with one embodiment of the invention.

The Stirling cooler may be in direct contact with the object to be cooled (e.g., gauge), as shown in FIG. 2, or placed a some distance from the gauge and cooled with a heat transport mechanism disposed therebetween to transfer heat, as shown in FIG. 3. FIG. 3 schematically illustrates that a heat pipe 35 is disposed between the Stirling cooler 22 and the gauge 104. As shown, heat can be conducted from, the gauge 104 to the Stirling cooler 22 as illustrated by arrow Qc. The Stirling cooler 22 then dissipates this heat to the fluid flow, as illustrated by arrow Qh. Those skilled in the art will appreciate that the heat transport mechanism may be any suitable heat transport device, including those implemented with circulating fluids. Therefore, the term "heat pipe" as used herein is intended to include any suitable heat transport mechanism, which may or may not comprise a "pipe." Embodiments of the invention may also be implemented with heat transport mechanisms on the cold side, or both the cold side and the hot side (not shown).

Figure 4:
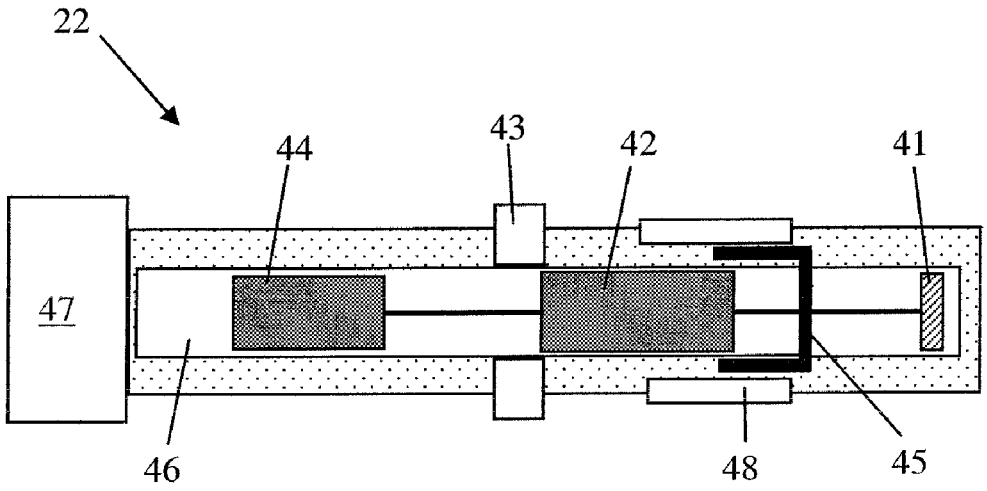
FIG. 4 shows a free-piston Stirling cooler in accordance with one embodiment of the invention.

Stirling coolers may have various configurations, using pistons and/or displacers. FIG. 4 shows a schematic of a free-piston type Stirling cooler that may be used with embodiments of the invention. As shown, the Stirling cooler 22 is attached to an object 47 to be cooled. As noted above, in some embodiments, a heat pipe may be used to conduct heat between the object 47 and the Stirling cooler 22. The Stirling cooler 22 includes two pistons 42, 44 disposed in cylinder 46. The cylinder 46 is filled with a working gas, typically air, helium or hydrogen at a pressure of several times (e.g., 20 times) the atmospheric pressure. The piston 42 is coupled to a permanent magnet 45 that is in proximity to an electromagnet 48 fixed on the housing. When the electromagnet 48 is energized, its magnetic field interacts with that of the permanent magnet 45 to cause linear motion (in the left and right directions looking at the figure) of piston 42. Thus, the permanent magnet 45 and the electromagnet 48 form a moving magnet linear motor. The particular sizes and shapes of the magnets shown in FIG. 4 are for illustration only and are not intended to limit the scope of the invention. One of ordinary skill in the a would also appreciate that the locations of the electromagnet and the permanent magnet may be reversed, i.e., the electromagnet may be fixed to the piston and the permanent magnet fixed on the housing (not shown).

The electromagnet 48 and the permanent magnet 45 may be made of any suitable materials. The windings and lamination of the electromagnet are preferably selected to sustain high temperatures (e.g. up to 260° C.). In some embodiments, the permanent magnets of the linear motors are made of a samarium-cobalt (Sm—Co) alloy to provide good performance at high temperatures. The electricity required for the operation of the electromagnet may be supplied from the surface, from batteries included in downhole tools, from generators downhole, or from any other means known in the art.

The movement of piston 42 causes the gas volume of cylinder 46 to vary. Piston 44 can move in cylinder 46 like a displacer in the kinematic type Stirling engines. The movement of piston 44 is triggered by a pressure differential across both sides of piston 44. The pressure differential results from the movement of piston 42. The movement of piston 44 in cylinder 46 moves the working gas from the left of piston 44 to the right of piston 44, and vice versa. This movement of gas coupled with the compression and decompression processes results in the transfer of heat from object 47 to heat dissipating device 43. As a result, the temperature of the object 47 decreases. In some embodiments, the Stirling cooler 22 may include a spring mass 41 to help reduce vibrations of the cooler resulting from the movements of the pistons and the magnet motor.

While FIG. 4 shows a Stirling cooler having a magnet motor that uses electricity to power the Stirling cooler, one skilled in the art would appreciate that other energy sources (or energizing mechanisms) may also be used. For example, operation of the Stirling cooler (e.g., the back and forth movements of piston 42 in FIG. 4) may be implemented by mechanical means, such as a fluid-powered system that uses the energy in the fluid flow coupled to a valve system and/or a spring (not shown). The hydraulic pressure of the fluid flow could be used to push the piston in one direction, while the spring is used to move the piston in the other direction. A conventional valve system may be used to control the flow of fluid to the Stirling piston in an intermittent fashion. Thus, the coordinated action of a hydraulic system, a spring, and a valve system results in a back and forth movement of the piston 42.

Figure 5:
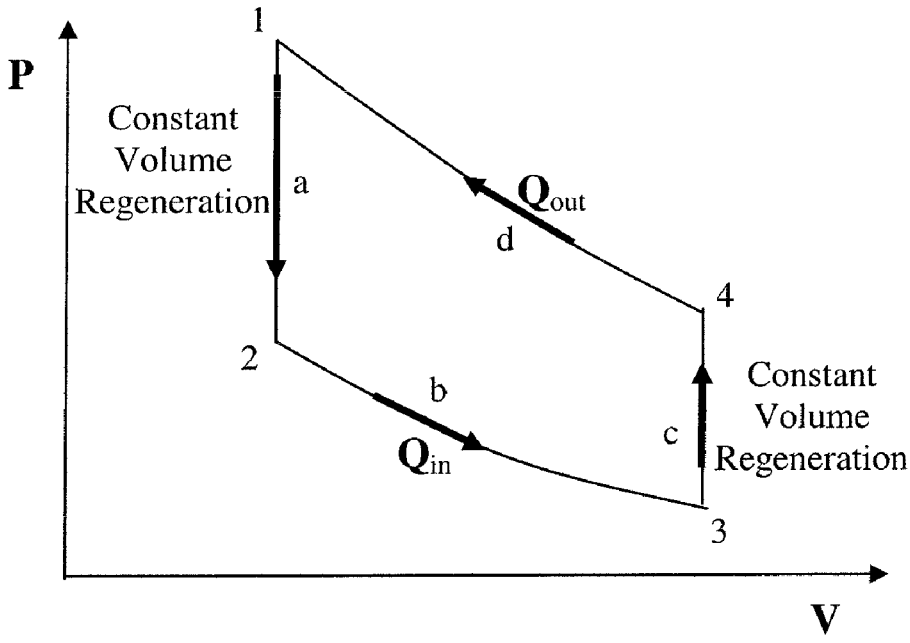
FIG. 5 (Prior Art)
FIG. 5 shows a diagram illustrating a Stirling cycle.
Figure 6:
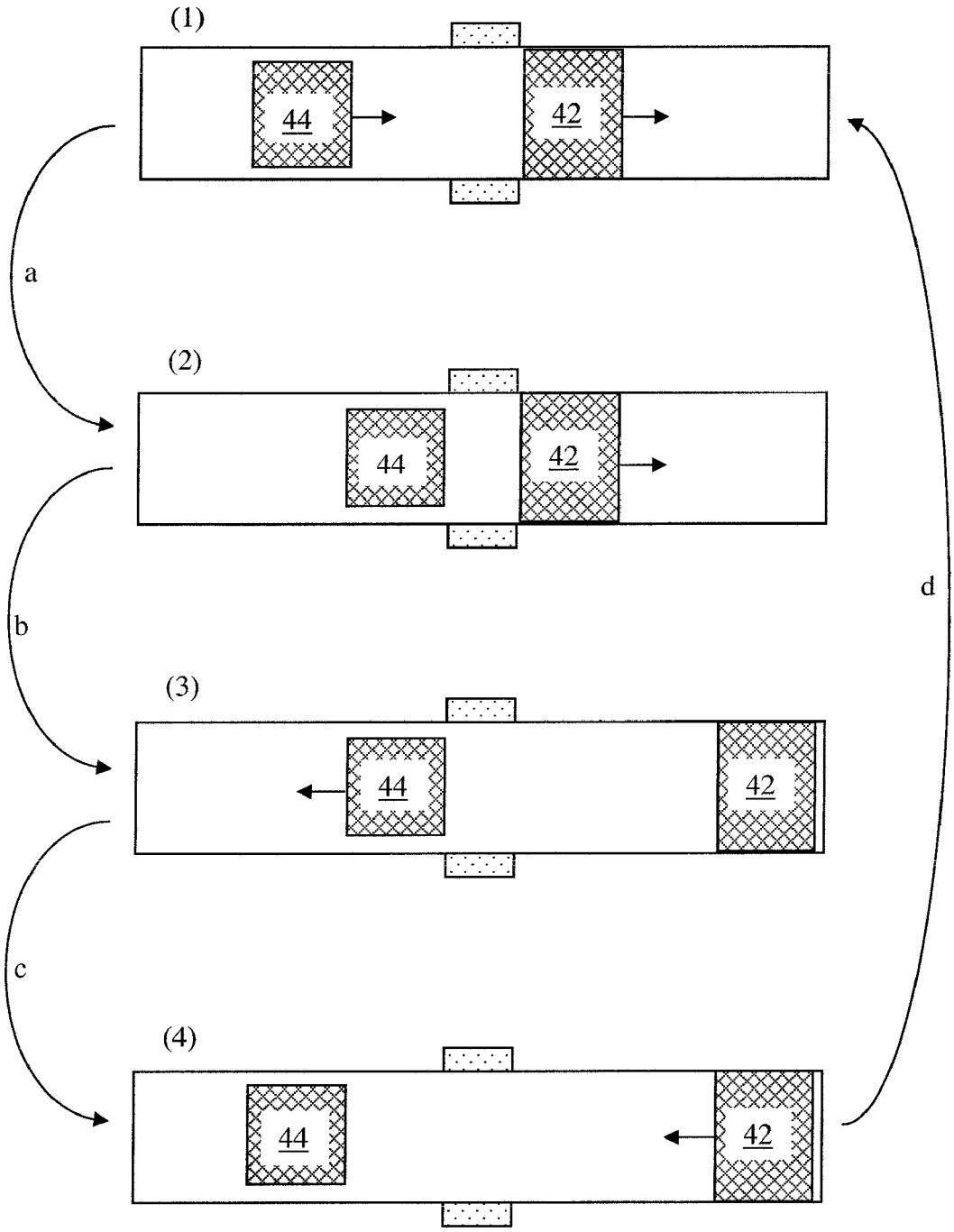
FIG. 6 shows a schematic illustrating various states of the pistons in the Stirling cooler in a Stirling cycle.

The movement of gas to the right and to the left of piston 44, coupled with compression and decompression of the gas in cylinder 46 by piston 42, creates four different states in a Stirling cycle. FIG. 5 depicts these four states and the transitions between these states in a pressure-volume diagram. FIG. 6 illustrates the four states and the direction of the movements of the pistons 42 and 44 in a Stirling cycle.

In process a (from state 1 to state 2), piston 44 moves from left to right in FIG. 6, while piston 42 remains stationary. Therefore, the volume in cylinder 46 (see FIG. 4) is unchanged. The working gas in the cylinder is swept from one side of piston 44 to the other side.

In the second process b (from state 2 to state 3), piston 42 moves to the right, increasing the volume in the cylinder (shown as 46 in FIG. 4). The magnet motor, for example, drives the movement of piston 42. Due to the increased volume in the cylinder, the gas expands and absorbs heat.

In process c (from state 3 to state 4), piston 44 moves to the left, forcing the working gas to move to its right. The volume of the gas remains unchanged.

In process d (from state 4 back to state 1), piston 42 moves to the left, driven by the magnet motor, for example. This compresses the working gas. The compression results in the release of heat from the working gas. The released heat is dissipated from the heat dissipater 43 into the heat sink or environment (e.g., the drilling mud). This completes the Stirling cycle. The net result is the transport of heat from one end of the device to the other. Thus, if the Stirling device is in thermal contact (either directly or via a heat pipe) with the object to be cooled (shown as 47 in FIG. 4), heat can be removed from the object. As a result, the temperature of the object is lowered or heat generated at the object can be removed.

Figure 7:
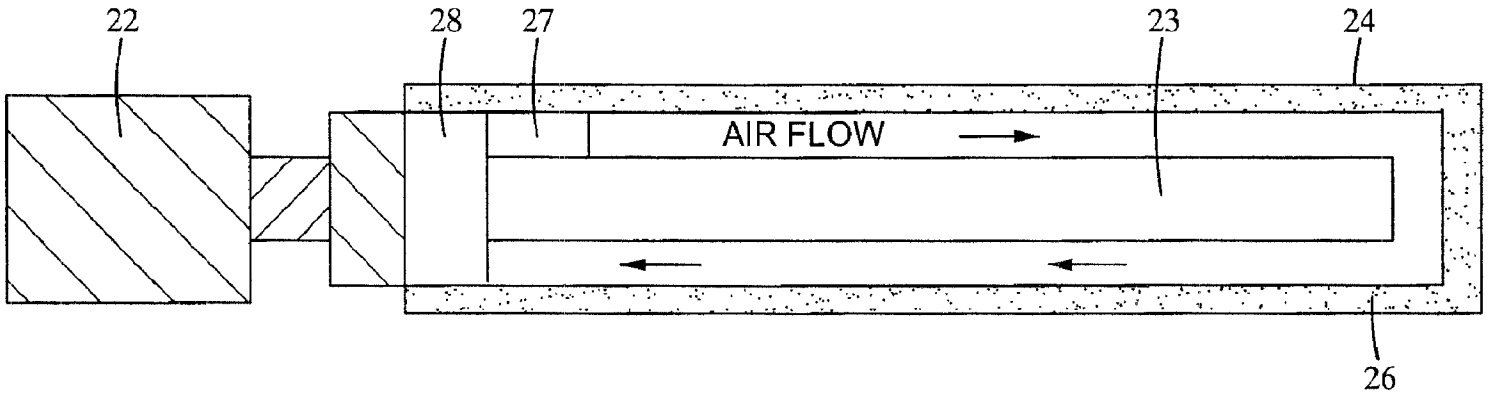
FIG. 7 shows a schematic illustrating a Stirling cooler coupled to a gauge of a submersible pumping system in accordance with one embodiment of the invention.

To improve heat removal from the insulating chamber (e.g., the chamber 104*b* of the gauge 104 in FIG. 2), auxiliary heat transfer/circulating mechanism may be used in conjunction with the Stirling coolers. For example, FIG. 7 shows a schematic of a system for heat removal using a Stirling cooler in accordance with another embodiment of the invention. As shown, a Stirling cooler 22 is coupled to an insulating enclosure or chamber 24. The chamber 24 is configured with an internal cavity 26 formed therein and adapted to provide an path over the component(s) to be cooled 23 housed therein. The cavity 26 may be formed using any conventional materials known in the art. A fan 27 is disposed within the chamber 24 to circulate air around the component 23 to be cooled, thereby actively transferring heat dissipating from the component(s) to the cold side of the Stirling cooler 22. The fan 27 may be powered by the electrical supply feeding the Stirling cooler or by an independent power network (e.g. separate battery) as known in the art. This particular embodiment is equipped with a heat exchanger 28 disposed at one end of the chamber 24 to increase cooling efficiency across the cooler/chamber interface and cool the recirculating air. The heat exchanger 28 may be a conventional heat sink or another suitable device as known in the art. Other embodiments may be implemented with multiple fans 27 to increase the cooling air flow.

Figure 8:
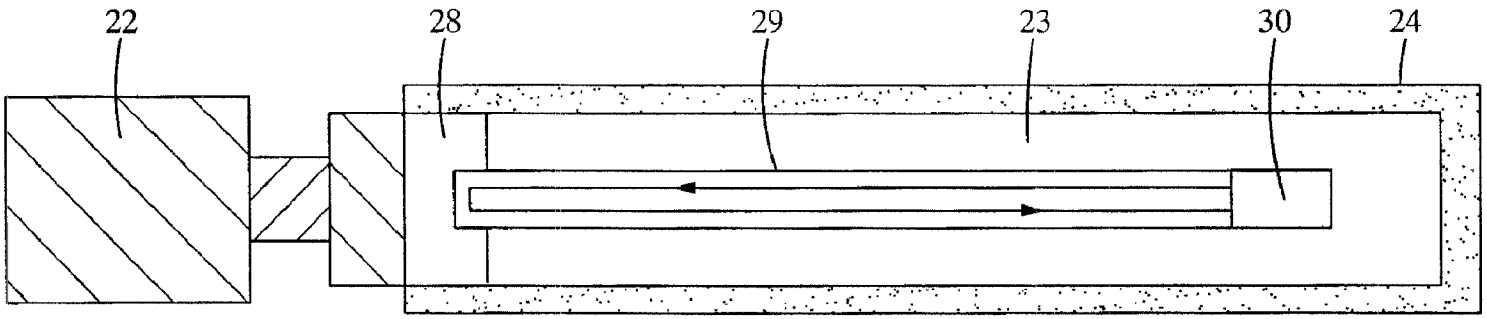
FIG. 8 shows a schematic illustrating s Stirling cooler coupled to a gauge of a submersible pumping system in accordance with another embodiment of the invention.

FIG. 8 shows a schematic of another system for heat removal using a Stirling cooler in accordance with an embodiment of the invention. As shown, a Stirling cooler 22 is coupled to an insulating enclosure or chamber 24. The chamber 24 is configured with an internal liquid-coolant system 29 disposed therein. The coolant system 29 is adapted with a flow loop that allows a liquid to flow in a closed loop from the housed component(s) 23 to a heat exchanger 28 attached to the cold side of the Stirling cooler 22. The coolant system 29 may be constructed using conventional materials known in the art (e.g., via multiple tubes). The heat exchanger 28 may be a conventional heat sink or another suitable device as known in the art. The coolant liquid, which may be water or any suitable alternative, is circulated in the flow loop via a pump 30 coupled to the flow lines and powered by the Stirling cooler 22 power network or using independent power means.

The Stirling cooler system of FIG. 8 is shown with the liquid-coolant system 29 centrally disposed within the chamber 24, such that the component(s) 23 to be cooled surround the coolant system. Those skilled in the art will appreciate that other embodiments of the invention may be implemented with the liquid-coolant system 29 in various configurations and lengths depending on space constraints. For example, embodiments of the invention may be implemented with the liquid-coolant system configured within, or forming, the walls of the insulating chamber (not shown). In such embodiments the liquid-coolant system would not be centrally disposed within the chamber 24. Embodiments comprising the liquid-coolant system 29 render increased cooling efficiency as the liquid collects the heat dissipated in the component 23 chamber and transfers it to the cold side of the Stirling 22 via the heat exchanger 28. In addition the use of liquid coolant, and, if desired in some embodiments, insulated coolant lines, allows a larger spatial separation between the Stirling cooler and the component to be cooled.

While the description related to FIGS. 4-6 uses a free-piston Stirling cooler to illustrate embodiments of the invention, one of ordinary skill in the art would appreciate that other types of Stirling coolers may also be used, including those based on kinematic mechanisms—e.g., double-piston Stirling coolers and piston-and-displacer Stirling coolers.

In accordance with embodiments of the invention, Stirling coolers are used to cool electronics, sensors or other heat sensitive parts that need to function in the harsh downhole environment. In these embodiments, the electronics are disposed in an insulating chamber (e.g., a Dewar flask) and the cold end of the Stirling cooler is coupled to (either directly, via a heat pipe or another heat transport mechanism) one side of the chamber. It has been found that a substantial amount of heat (e.g., 150 W) could be removed with the cooler embodiments of the invention. Thus, it is possible to maintain an environment below 125° C. for the electronics, even when the temperature in the borehole may be 175° C. or higher. Model studies also indicate that the Stirling cooler embodiments of the invention are capable of removing heat at a rate of up to 400 W.

Some aspects of the invention relate to methods for producing a downhole electrical submersible pumping system having a Stirling cooling system. A schematic of a portion of a downhole electrical submersible pumping system including a Stirling cooler embodiment of the invention is illustrated in FIG. 1. A electrical submersible pumping system may be in oil and gas production.

Figure 9:
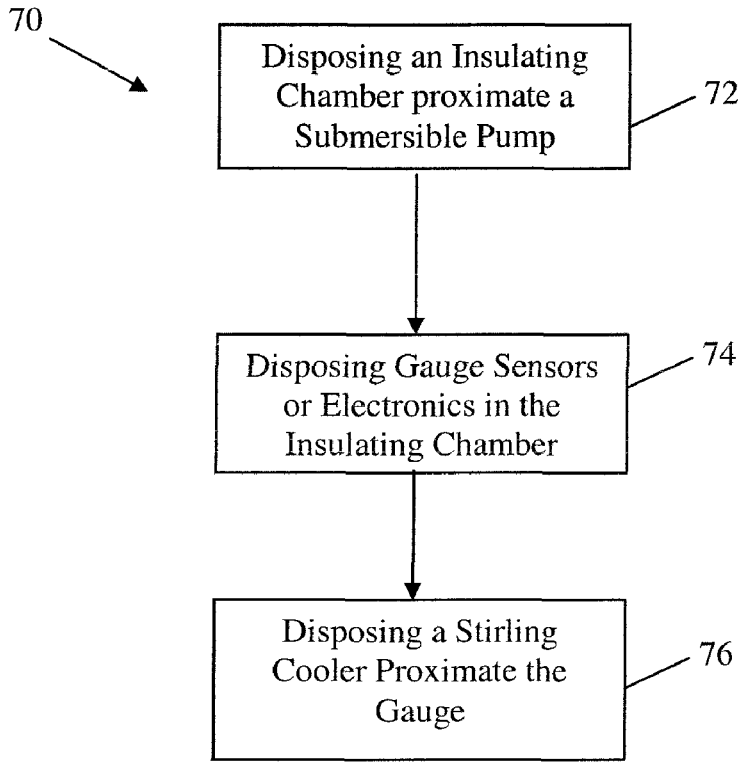
FIG. 9 illustrates a method for manufacturing an electrical submersible pumping system in accordance with one embodiment of the invention.

FIG. 9 shows a process for producing an electrical submersible pumping system in accordance with one embodiment of the invention. As shown, the process 70 includes disposing an insulating chamber in a downhole tool that includes a submersible pump (step 72). The insulating chamber forms the wall of a gauge (shown as 104 in FIGS. 1 and 2) and may be a Dewar flask or a chamber made of an insulating material suitable for downhole use. In some embodiments, the insulating chamber may be formed by a cutout on the insulating tool body. Then, the gauge electronics or sensors that need to function at relative low temperatures are placed into the insulating chamber (step 74). Alternatively, the electronics or sensors may be placed in the insulating chamber before the latter is placed proximate the submersible pump. Then, a Stirling cooler is disposed proximate the gauge of the submersible pumping system (step 76). Note that the relative order of placement of the Stirling cooler and the insulating chamber is not important, i.e., the Stirling cooler may be placed before the insulating chamber. Preferably, the Stirling cooler is placed proximate the insulating chamber. However, if space limitations do not permit placement of the Stirling cooler proximate the insulating chamber, the Stirling cooler may be placed at a distance from the insulating chamber (as shown in FIG. 3) and a heat pipe or other heat transport device may be used to conduct heat from the insulating chamber to the Stirling cooler.

Figure 10:
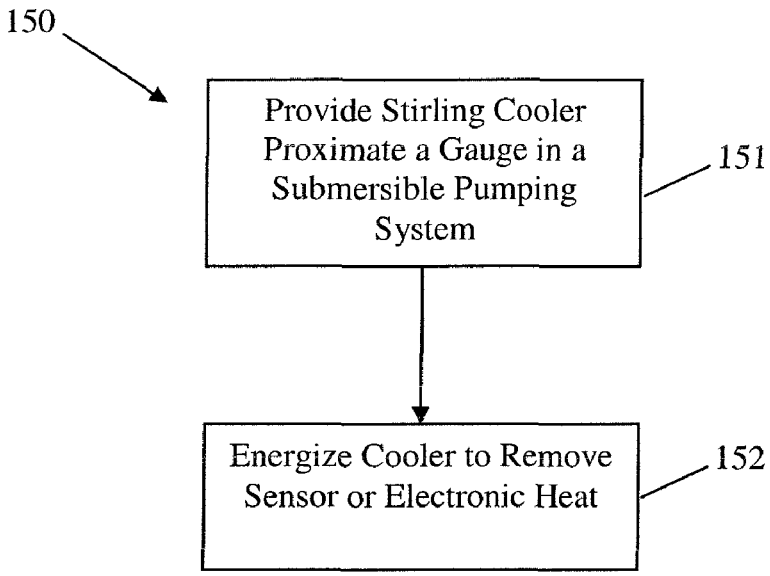
FIG. 10 illustrates a method for cooling a submersible pumping system using a Stirling cooler in accordance with one embodiment of the invention.

FIG. 10 shows a process for cooling a sensor or electronics in a gauge disposed in an electrical submersible pumping system in accordance with one embodiment of the invention. The process 150 includes providing a Stirling cooler in the submersible pumping system proximate a gauge having the sensor or electronics (step 151); and energizing the Stirling cooler such that heat is removed from the sensor or electronics in the gauge (step 152).

Advantages of the present invention include improved cooling/refrigeration techniques for submersible pumping systems. A submersible pump with a Stirling cycle cooling system in accordance with embodiments of the invention can keep the electrical components and sensors (e.g., those associated with a gauge designed for used with a submersible pumping system) at significantly lower temperatures, enabling these components to render better performance and longer service lives in harsh operating conditions. This in turn allows for improved production optimization in wells with harsh operating conditions.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A submersible pumping system, comprising: an electric submersible pump comprising a motor, a pump, and a protector;

a gauge disposed proximate the electric submersible pump;

a Stirling cooler disposed proximate the gauge, wherein the Stirling cooler has a cold end configured to remove heat from the gauge and a hot end configured to dissipate heat; and an energy source configured to power the submersible pumping system.

2. The submersible pumping system of claim 1, wherein the gauge is configured to monitor performance of the submersible pump.

3. The submersible pumping system of claim 1, wherein the Stirling cooler is further configured to remove heat from electronic components of the submersible pump.

4. The submersible pumping system of claim 1, wherein the Stirling cooler is a free-piston Stirling cooler.

5. The submersible pumping system of claim 4, wherein the free-piston Stirling cooler comprises a permanent magnet.

6. The submersible pumping system of claim 1, wherein the Stirling cooler is a kinematic type Stirling cooler.

7. The submersible pumping system of claim 1, further comprising a heat pipe disposed between the cold end of the Stirling cooler and the gauge, wherein the heat pipe is adapted to conduct heat from the gauge to the cold end of the Stirling cooler.

8. The submersible pumping system of claim 1, wherein the hot end of the Stirling cooler is configured to dissipate heat into a fluid flowing by the motor.

9. A method for constructing a submersible pumping system, comprising: disposing a gauge proximate an electric submersible pump comprising a motor, a pump, and a protector; and disposing a Stirling cooler proximate the gauge such that the Stirling cooler is configured to remove heat from the gauge.

10. The method of claim 9, wherein the Stirling cooler is a free-piston Stirling cooler.

11. The method of claim 9, wherein the Stirling cooler is a kinematic Stirling cooler.

12. The method of claim 9, further comprising disposing a heat pipe between a cold end of the Stirling cooler and the gauge, wherein the heat pipe is adapted to conduct heat from the gauge to the cold end of the Stirling cooler.

13. The method of claim 9, further comprising arranging a hot end of the Stirling cooler to dissipate heat into a fluid flowing by the submersible pump.

14. A method for cooling a gauge of a submersible pumping system, comprising: placing an electric submersible pump comprising a motor, a pump, and a protector downhole in a subterranean hydrocarbon well, providing a gauge proximate to the electric submersible pump, providing a Stirling cooler proximate the gauge; and energizing the Stirling cooler such that heat is removed from the gauge.

15. The method of claim 14, wherein the Stirling cooler is a free-piston Stirling cooler.

16. The method of claim 14, wherein the Stirling cooler is a kinematic Stirling cooler.

17. The method of claim 14, wherein the heat is removed from the gauge via a heat pipe disposed between the Stirling cooler and the gauge.

* * * * *